US009875683B2

(12) United States Patent
Lim et al.

(10) Patent No.: US 9,875,683 B2
(45) Date of Patent: Jan. 23, 2018

(54) SCAN DRIVER FOR OUTPUTTING A SENSING SCAN SIGNAL TO DETECT A DRIVING CURRENT OF PIXELS AND DISPLAY DEVICE HAVING THE SAME

(71) Applicant: SAMSUNG DISPLAY CO., LTD., Yongin-si, Gyeonggi-do (KR)

(72) Inventors: Jae-Keun Lim, Suwon-si (KR); Ji-Hye Lee, Yongin-si (KR); Yong-Koo Her, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 66 days.

(21) Appl. No.: 14/993,051

(22) Filed: Jan. 11, 2016

(65) Prior Publication Data

US 2016/0372024 A1 Dec. 22, 2016

(30) Foreign Application Priority Data

Jun. 16, 2015 (KR) ..... 10-2015-0085213

(51) Int. Cl.

| | |
|---|---|
| ***G09G 3/32*** | (2016.01) |
| ***G09G 3/20*** | (2006.01) |
| ***G09G 3/3266*** | (2016.01) |
| ***G09G 3/36*** | (2006.01) |

(52) U.S. Cl.

CPC ..... *G09G 3/2092* (2013.01); *G09G 3/3266* (2013.01); *G09G 3/3677* (2013.01); *G09G 3/3696* (2013.01); *G09G 2300/0426* (2013.01); *G09G 2310/0202* (2013.01); *G09G 2310/0278* (2013.01); *G09G 2310/0291* (2013.01)

(58) Field of Classification Search

CPC ..... G09G 3/2092
USPC ..... 345/82
See application file for complete search history.

(56) References Cited

U.S. PATENT DOCUMENTS

2014/0111403 A1* 4/2014 Kim ..... G11C 19/28 345/76
2015/0023429 A1 1/2015 Narayanan et al.
2015/0317954 A1* 11/2015 Jang ..... G09G 3/20 345/213
2016/0217728 A1* 7/2016 In ..... G09G 3/3275

FOREIGN PATENT DOCUMENTS

JP 2008-067145 A 3/2008
KR 10-2010-0011285 A 2/2010

* cited by examiner

*Primary Examiner* — Long D Pham
(74) *Attorney, Agent, or Firm* — Lewis Roca Rothgerber Christie LLP

(57) ABSTRACT

A scan driver includes a plurality of decoder type stages respectively outputting a plurality scan signals. An n-th stage includes a first input block configured to provide a first DC voltage to a first node in response to a plurality of selection signals, a pull-down block configured to pull down a first node voltage, a second input block configured to reduce a voltage drop of a second node voltage when a scan signal is output, and to provide a second DC voltage to a second node in response to the selection signals, a buffer block configured to output the first node voltage, that is a buffer output voltage, in response to the first node voltage and the second node voltage, and an output block configured to output the scan signal.

20 Claims, 10 Drawing Sheets

SCAN DRIVER FOR OUTPUTTING A SENSING SCAN SIGNAL TO DETECT A DRIVING CURRENT OF PIXELS AND DISPLAY DEVICE HAVING THE SAME

CROSS REFERENCE TO RELATED APPLICATION

This application claims priority to, and the benefit of, Korean Patent Applications No. 10-2015-0085213, filed on Jun. 16, 2015 in the Korean Intellectual Property Office (KIPO), the disclosure of which is hereby incorporated by reference herein in its entirety.

BACKGROUND

1. Field

Embodiments of the present invention relate to display devices. More particularly, embodiments of the present invention relate to decoder type scan drivers and display devices having the same.

2. Description of the Related Art

A display device includes a display panel and a display panel driver. The display panel includes scan lines, data lines, and pixels. The display driver includes a controller, a scan driver, and a data driver. Recently, a scan signal (e.g., a sensing scan signal) is applied to the pixels or pixel lines to detect a degradation of a driving transistor, detect threshold voltage shift, detect a degradation of an organic light emitting diode, etc. Thus, a sensing scan line that is separate from the scan lines is coupled to the pixels, and an additional scan driver for sensing the pixels that provide the sensing scan signal to the sensing scan line is included in the display device.

The scan driver for sensing the pixels includes a plurality of stages connected to each of the sensing scan lines. The stages include a plurality of switch elements. A current leakage and voltage drops in the stages occurs due to internal resistances of the switch elements, threshold voltage shifts of the switch elements, etc. Thus, a voltage level of the sensing scan signal outputted from the stages may fluctuate and/or may be unexpectedly dropped.

SUMMARY

Example embodiments provide a decoder type scan driver including a buffer block and a second input block to improve a reliability of output voltage level of a scan signal.

Example embodiments provide a display device having the scan driver.

According to example embodiments, a scan driver may include a plurality of decoder type stages respectively outputting a plurality scan signals. An n-th stage may include a first input block configured to provide a first direct current (DC) voltage to a first node in response to a plurality of selection signals, a pull-down block configured to provide a second DC voltage to the first node and to pull down a first node voltage, a second input block configured to reduce a voltage drop of a second node voltage when a scan signal is output, and to provide the second DC voltage to a second node in response to the selection signals, a buffer block configured to output the first node voltage, that is a buffer output voltage, in response to the first node voltage and the second node voltage, and an output block configured to output the scan signal in response to the second node voltage, the buffer output voltage, and a first clock signal, wherein n is a positive integer.

In example embodiments, the buffer block may include: a first buffer switch; and a second buffer switch connected in series to the first buffer switch, and the buffer block may provide the buffer output voltage to the output block.

In example embodiments, the first buffer switch may include a gate electrode connected to the second node, a source electrode to which the first DC voltage is applied, and a drain electrode connected to a third node. The second buffer switch may include a gate electrode connected to the first node, a source electrode connected to the drain electrode of the first buffer switch, and a drain electrode to which the second DC voltage is applied.

In example embodiments, the first input block may include a first switch, a second switch, and a third switch connected in series to each other. The second input block may include a fourth switch, a fifth switch, a sixth switch, and a cutoff switch connected in series to each other.

In example embodiments, the first switch may include a gate electrode to which a first selection signal is applied, a source electrode to which the first DC voltage is applied, and a drain electrode connected to the second switch. The second switch may include a gate electrode to which a second selection signal is applied, a source electrode connected to the drain electrode of the first switch, and a drain electrode connected to the third switch. The third switch may include a gate electrode to which a third selection signal is applied, a source electrode connected to the drain electrode of the second switch, and a drain electrode connected to the first node.

In example embodiments, fourth switch may include a gate electrode to which a first selection signal is applied, a source electrode connected to the second node, and a drain electrode connected to the fifth switch. The fifth switch may include a gate electrode to which a second selection signal is applied, a source electrode connected to the drain electrode of the fourth switch, and a drain electrode connected to the sixth switch. The sixth switch may include a gate electrode to which a third selection signal is applied, a source electrode connected to the drain electrode of the fifth switch, and a drain electrode connected to the cutoff switch. The cutoff switch may include a gate electrode to which a second clock signal is applied, a source electrode connected to the drain electrode of the sixth switch, and a drain electrode to which the second DC voltage is applied.

In example embodiments, the second clock signal may be a signal inverted from the first clock signal.

In example embodiments, the n-th stage may further include an inverting block configured to generate the second clock signal based on the first clock signal, and to apply the second clock signal to the gate electrode of the cutoff switch.

In example embodiments, the inverting block may include a first inverting switch and a second inverting switch connected in series to each other. The first inverting switch may include a gate electrode to which the first clock signal is applied, a source electrode to which the first DC voltage is applied, and a drain electrode connected to the second inverting switch. The second inverting switch may include a gate electrode to which the second DC voltage is applied, a source electrode connected to the drain electrode of the first inverting switch, and a drain electrode connected to the gate electrode of the second inverting switch.

In example embodiments, the gate electrode of the cutoff switch may be connected to the drain electrode of the first inverting switch and the source electrode of the second inverting switch.

In example embodiments, the output block may include a first output switch including a gate electrode to which the buffer output voltage is applied, a source electrode connected to the second node, and a drain electrode connected to an output terminal, a second output switch including a gate electrode connected to the second node, a source electrode to which the first DC voltage is applied, and a drain electrode connected to the output terminal, a third output switch including a gate electrode connected to the second node, a source electrode connected to the output terminal, and a drain electrode to which the first clock signal is applied, and a capacitor connected between the second node and the third output switch.

In example embodiments, the second node voltage may be bootstrapped by the capacitor when the third output switch is turned on, so that the scan signal is output.

In example embodiments, the pull-down block may include a bootstrap circuit. The pull-down block may pull down the first node voltage into the second DC voltage when an operation that the first input block applies the first DC voltage to the first node is stopped.

In example embodiments, the second DC voltage may be lower than the first DC voltage.

According to example embodiments, a display device may include a display panel including a plurality of pixels, a data driver configured to provide a data signal to the pixels, a first scan driver configured to provide a scan signal to the pixels, and a second scan driver, that is a decoder type scan driver, configured to provide a sensing scan signal to the pixels to detect a driving current of each of the pixels in a set (e.g., a predetermined) sensing period. An n-th stage of the second scan driver may include a first input block configured to provide a first direct current (DC) voltage to a first node in response to a plurality of selection signals, a pull-down block configured to provide a second DC voltage to the first node and to pull down a first node voltage, a second input block configured to reduce a voltage drop of a second node voltage when the sensing scan signal outputs, and configured to provide the second DC voltage to a second node in response to the selection signals, a buffer block configured to output the first node voltage, that is a buffer output voltage, in response to the first node voltage and the second node voltage, and an output block configured to output the sensing scan signal in response to the second node voltage, the buffer output voltage, and a first clock signal, wherein n is a positive integer.

In example embodiments, the second scan driver may select a sensing scan line, to output the sensing scan signal to, based on turn-on voltage level of the selection signals.

In example embodiments, the buffer block may include a first buffer switch and a second buffer switch connected in series to each other, and the buffer block may provide the buffer output voltage to the output block.

In example embodiments, the first buffer switch may include a gate electrode connected to the second node, a source electrode to which the first DC voltage is applied, and a drain electrode connected to a third node. The second buffer switch may include a gate electrode connected to the first node, a source electrode connected to the drain electrode of the first buffer switch, and a drain electrode to which the second DC voltage is applied.

In example embodiments, the second input block may include a cutoff switch configured to reduce the voltage drop of the second node voltage based on a second clock signal, which is a signal inverted from the first clock signal, when the sensing scan signal is output.

In example embodiments, the display device may further include a controller configured to control the data driver, the first scan driver, and the second scan driver.

Therefore, the scan driver for generating the sensing scan signal and the display device having the same according to example embodiments may include the buffer block and the cutoff switch in each of the stages, so that voltage drops and current leakages in the stages may be prevented or reduced, and so that threshold voltage shift margins of the switches may be ensured. Thus, the voltage level fluctuation of the scan signal (i.e., the sensing scan signal) outputted to the scan line (i.e., the sensing scan line) may be prevented or reduced, and a reliability of the voltage level of the scan signal may be improved.

BRIEF DESCRIPTION OF THE DRAWINGS

Example embodiments can be understood in more detail from the following description taken in conjunction with the accompanying drawings, in which.

DETAILED DESCRIPTION

Figure 1:
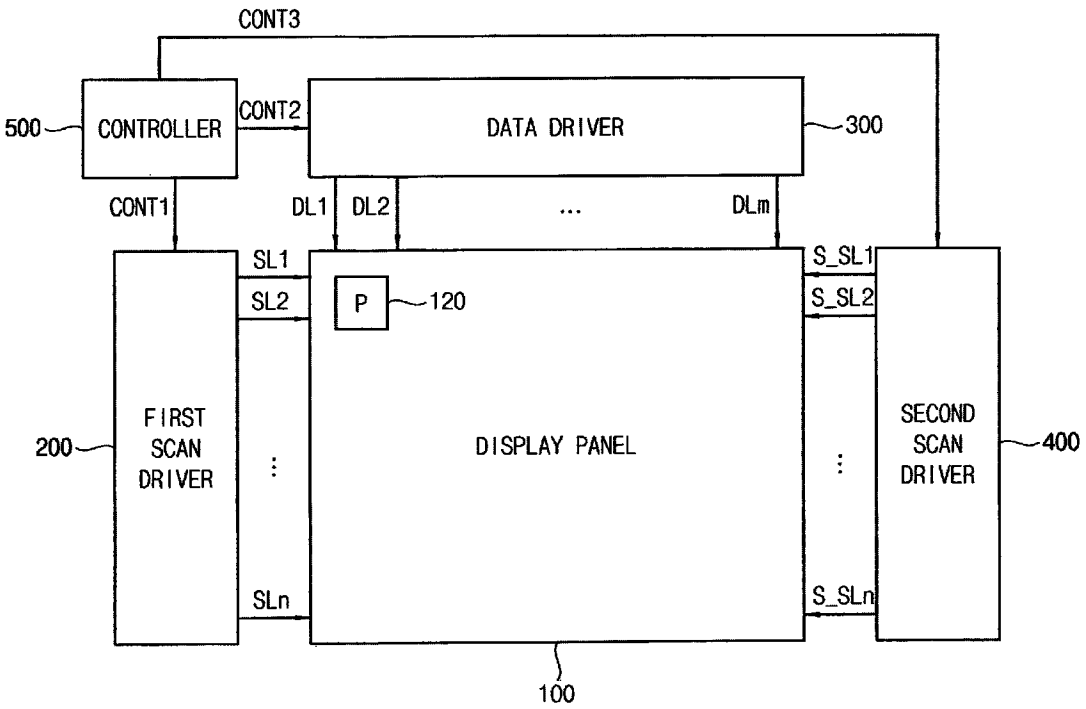
FIG. 1 is a block diagram of a display device according to example embodiments.

Exemplary embodiments will be described more fully hereinafter with reference to the accompanying drawings, in which various embodiments are shown.

It will be understood that, although the terms "first", "second", "third", etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer, or section discussed below could be termed a second element, component, region, layer, or section, without departing from the spirit and scope of the present invention.

Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Further "connection," "connected," etc. may also refer to "electrical connection," "electrically connect," etc. depending on the context in which they are used as those skilled in the art would appreciate. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

FIG. 1 is a block diagram of a display device according to example embodiments.

Referring to FIG. 1, the display device 1000 may include a display panel 100, a first scan driver 200, a data driver 300, and a second scan driver 400. The display device 1000 may further include a controller 500. For example, the display device 1000 may be an organic light emitting display device. Alternatively, the display device 1000 may be a liquid crystal display device.

The first scan driver 200 may provide a scan signal to the display panel 100 to display an image, and the second scan driver 400 may provide a scan signal (i.e., a sensing scan signal) to the display panel 100 to detect driving currents of the pixels.

The display panel 100 may include a plurality of pixels 120, and may display an image. That is, the pixels 120 may be respectively arranged at locations corresponding to crossing regions of a plurality of scan lines SL1 through SLn, a plurality of sensing scan lines S_SL1 through S_SLn, and a plurality of data lines DL1 through DLm.

The first scan driver 200 may respectively provide the scan signal to the pixels 120 of the display panel 100 via the scan lines SL1 through SLn. In one embodiment, the first scan driver 200 may provide the scan signal based on a first control signal CONT1 received from the controller 500. The data driver 300 may provide a data signal to the pixels 120 of the display panel 100 via the data lines DL1 through DLm, respectively. In one embodiment, the data driver 300 may provide the data signal to the display panel 100 based on a second control signal CONT2 received from the controller 500.

The second scan driver 400 may provide the sensing scan signal to the pixels 120 of the display panel 100 via the sensing scan lines S_SL1 through S_SLn, respectively. The second scan driver 400 may provide the sensing scan signal to selected sensing scan lines among the sensing scan lines S_SL1 through S_SLn to detect the driving currents of the pixels 120 during a set (e.g., a predetermined) sensing period. The second scan driver 400 may be a decoder type scan driver having a plurality of decoder stages. In one embodiment, the second scan driver 400 may receive a plurality of selection signals, may select one of the sensing scan lines S_SL1 through S_SLn based on turn-on levels of the selection signals, and may output the sensing scan signal to the selected sensing scan line. Thus, the display device 1000 may include the second scan driver 400 to detect reliability of pixels of a specific portion, degradation of a driving transistor, threshold voltage shift, a degradation of an organic light emitting diode, etc. The second scan driver 400 may operate independently of the first scan driver 200.

Each of the stages of the second scan driver 400 may include a first input block configured to provide a first direct current (DC) voltage to a first node in response to the selection signals, may include a pull-down block configured to provide a second DC voltage to the first node and to pull down a first node voltage, may include a second input block configured to prevent or reduce a voltage drop of a second node voltage when the sensing scan signal is output, and configured to provide the second DC voltage to a second node in response to the selection signals, may include a buffer block configured to output the first node voltage, that is a buffer output voltage, in response to the first node voltage and to the second node voltage, and an output block configured to output the sensing scan signal in response to the second node voltage, the buffer output voltage, and a first clock signal.

The controller 500 may control the data driver 300, the first scan driver 200, and the second scan driver 400. The controller 500 may generate the first to third control signals CONT1, CONT2, and CONT3, and may respectively provide the first to third control signals CONT1, CONT2, and CONT3 to the first scan driver 200, the data driver 300, and the second scan driver 400 to control the first scan driver 200, the data driver 300, and the second scan driver 400.

Figure 2:
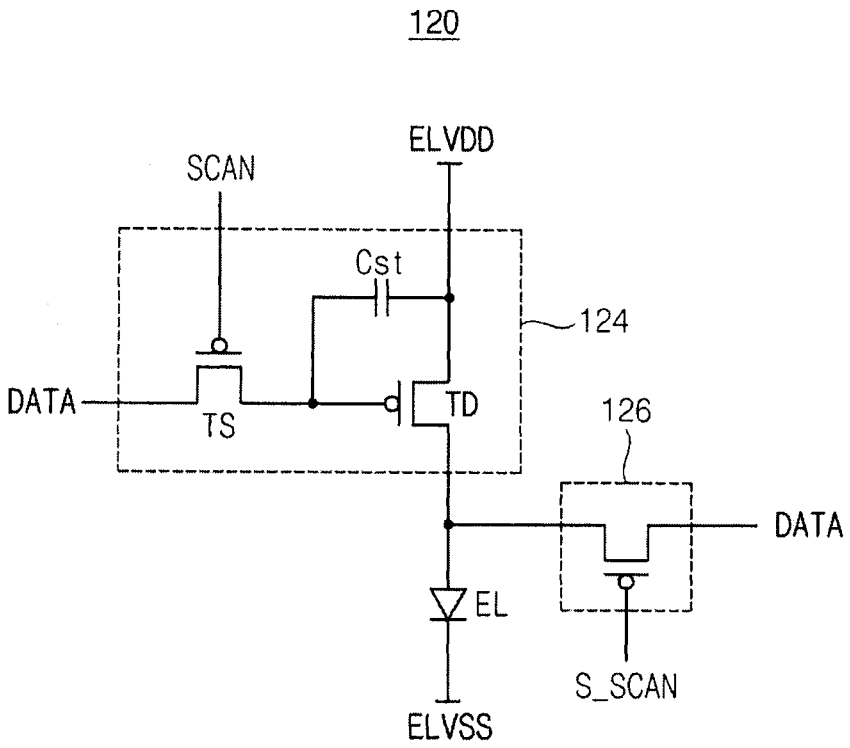
FIG. 2 is a diagram illustrating an example of a pixel included in the display device of FIG. 1.

FIG. 2 is a diagram illustrating an example of a pixel included in the display device of FIG. 1.

Referring to FIG. 2, the pixel 120 may include an organic light emitting diode EL, a pixel circuit 124, and a sensing circuit 126.

An anode of the organic light emitting diode EL may be connected to the pixel circuit 124, and a cathode of the organic light emitting diode EL may be connected to a second power voltage ELVSS. The organic light emitting diode EL may generate light having a luminance that corresponds to the driving current from the pixel circuit 124.

The pixel circuit 124 may provide the driving current to the organic light emitting diode EL to emit light. The pixel circuit 124 may generate the driving current by a variety of pixels structures known to those of skill in the art, such as 2T1C, 3T1C, 6T2C, 7T2C, etc. In one embodiment, the pixel circuit 124 may include a driving transistor TD, a switching transistor TS, and a storage capacitor Cst.

The switching transistor TS may include a gate electrode connected to a scan line, a first electrode coupled to a data line, and a second electrode connected to a gate electrode of the driving transistor TD. A scan signal SCAN may be provided to the gate electrode of the switching transistor TS, and a data signal DATA may be provided to the first electrode of the switching transistor TS.

The driving transistor TD may include the gate electrode connected to the second electrode of the switching transistor TS, a first electrode connected to a first power voltage ELVDD, and a second electrode connected to the anode of the organic light emitting diode EL. When the scan signal SCAN and the data signal DATA are respectively applied to the scan line and the data line, the switching transistor TS and the driving transistor TD may be turned on, and the driving current is generated so that the organic light emitting diode EL may emit light. The pixel circuit 124 may further include the storage capacitor Cst connected between the gate electrode of the driving transistor TD and the first electrode of the driving transistor TD.

In one embodiment, when the transistors are PMOS (P-channel metal oxide semiconductor), the first electrode may correspond to a source electrode, and the second electrode may correspond to a drain electrode. In one embodiment, when the transistors are NMOS (N-channel metal oxide semiconductor), the first electrode may correspond to a drain electrode and the second electrode may correspond to a source electrode.

The sensing circuit 126 may receive a sensing scan signal S_SCAN, and may provide the data signal DATA to the pixel 120 to detect the degradation of the driving transistor TD, to detect the threshold voltage shift, and to detect the degradation of the organic light emitting diode EL. Hereinafter, structures and operations of the second scan driver 400 for improving a fluctuation and voltage drop of a level of the sensing scan signal S_SCAN will be explained with reference to FIGS. 3 to 10.

Figure 3:
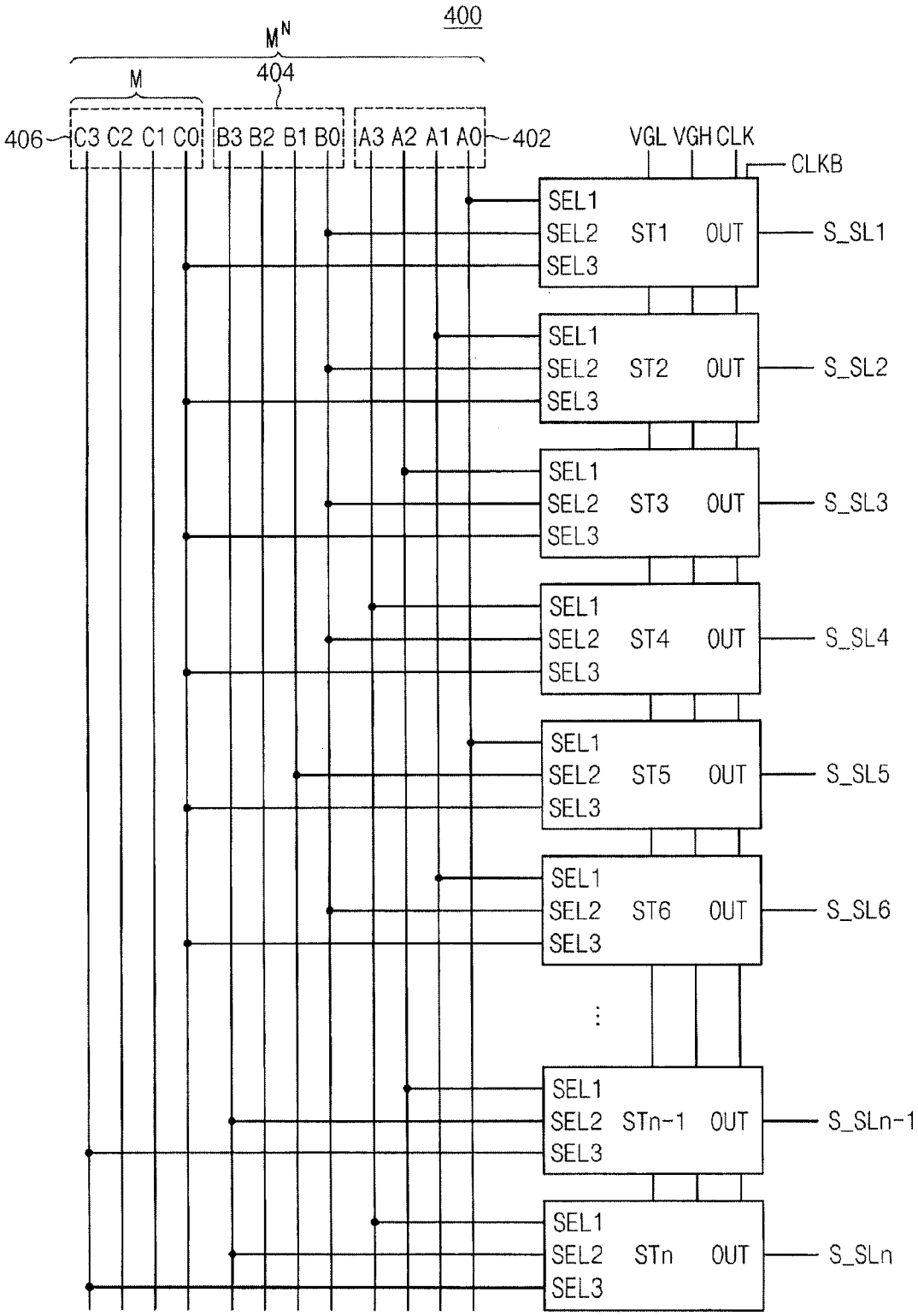
FIG. 3 a block diagram of a scan driver according to example embodiments.

FIG. 3 a block diagram of a scan driver according to example embodiments.

Referring to FIG. 3, the second scan driver 400 may include a plurality of decoder type stages ST1 through STn. The stages ST1 through STn may output scan signals (i.e., sensing scan signals) to sensing scan lines S_SL1 through S_SLn, respectively.

Hereinafter, example embodiments will be explained with the second scan driver 400 including PMOS transistors. Because these are examples, the second scan driver 400 may include NMOS transistors in other embodiments.

Each of the stages ST1 through STn may include a first input terminal SEL1, a second input terminal SEL2, a third input terminal SEL3, and an output terminal OUT. Each of the stages ST1 through STn may receive a first direct current (DC) voltage VGH, a second DC voltage VGL, a first clock signal CLK, and a second clock signal CLKB.

In one embodiment, the second clock signal CLKB may be a signal inverted from the first clock signal CLK, and the second DC voltage VGL may be lower than the first DC voltage VGH.

The second scan driver 400 may select a scan line (e.g., a sensing scan line) to which the scan signal is output based on voltage levels of a plurality of selection signals. In one embodiment, the second scan driver 400 may include a plurality of sub-decoders 402, 404, and 406 that selectively output the selection signals. For example, the second scan driver 400 may include N sub-decoders 402, 404, and 406, and each of the sub-decoders 402, 404, and 406 may output one of M selection signals, where N and M are integers greater than 1. Thus, the second scan driver 400 may selectively drive $M^N$ scan lines S_SL1 through S_SLn. Because this is an example, the number of selection signals selected by the sub-decoders may be different from each other.

In FIG. 3, $4^3$ input signals are connected to the first to third input terminals SEL1, SEL2, and SEL3 of corresponding ones of the stages ST1 through STn, such that the second scan driver 400 may selectively drive 64 scan lines.

Each of the stages ST1 through STn may receive corresponding selection signals among the selection signals output from the sub-decoders 402, 404, and 406.

For example, for generating a sensing scan signal provided to a first scan line S_SL1, the first stage ST1 may receive an A0 signal of four selection signals (i.e., four selection signals indicated as A0, A1, A2, and A3) from the first sub-decoder 402, a B0 signal of four selection signals (i.e., four selection signals indicated as B0, B1, B2, and B3) from the second sub-decoder 404, and a C0 signal of four selection signals (i.e., four selection signals indicated as C0, C1, C2, and C3) from the third sub-decoder 406. The selection signals A0, B0, and C0 may be provided to the first to third selection terminals SEL1, SEL2, and SEL3.

The stage that received the selection signals may output the scan signal.

Figure 4:
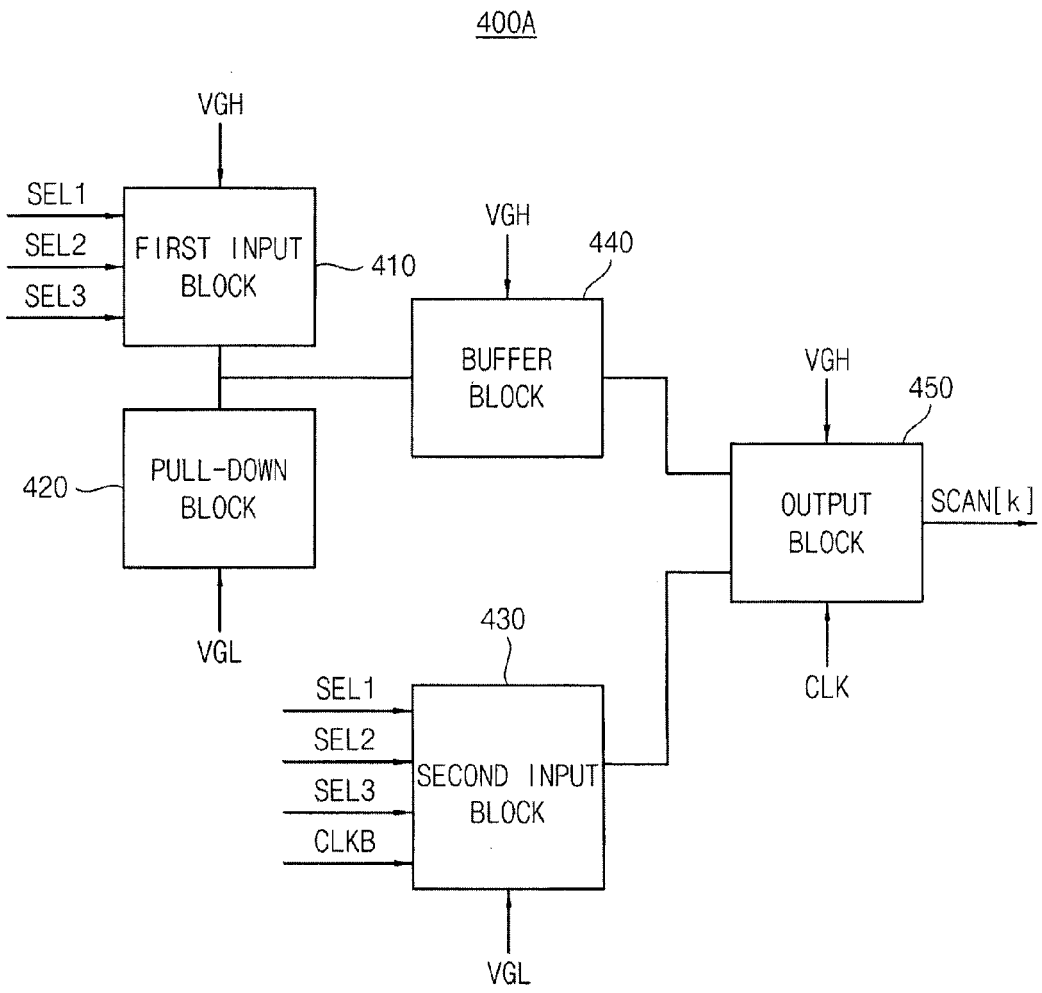
FIG. 4 is a block diagram illustrating an example of a k-th stage of the scan driver of FIG. 3.
Figure 5:
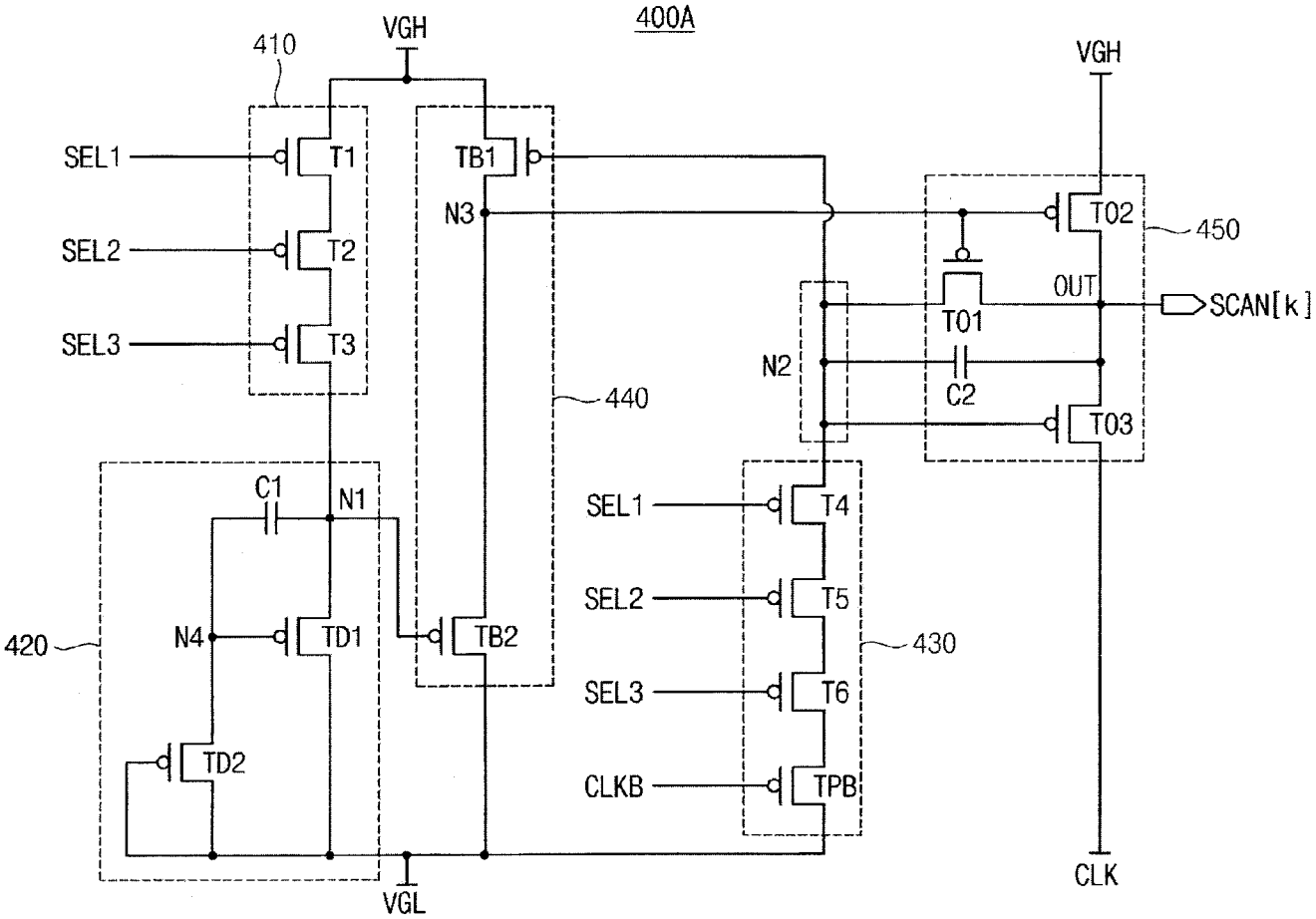
FIG. 5 is a circuit diagram illustrating an example of the k-th stage of FIG. 4.
Figure 6:
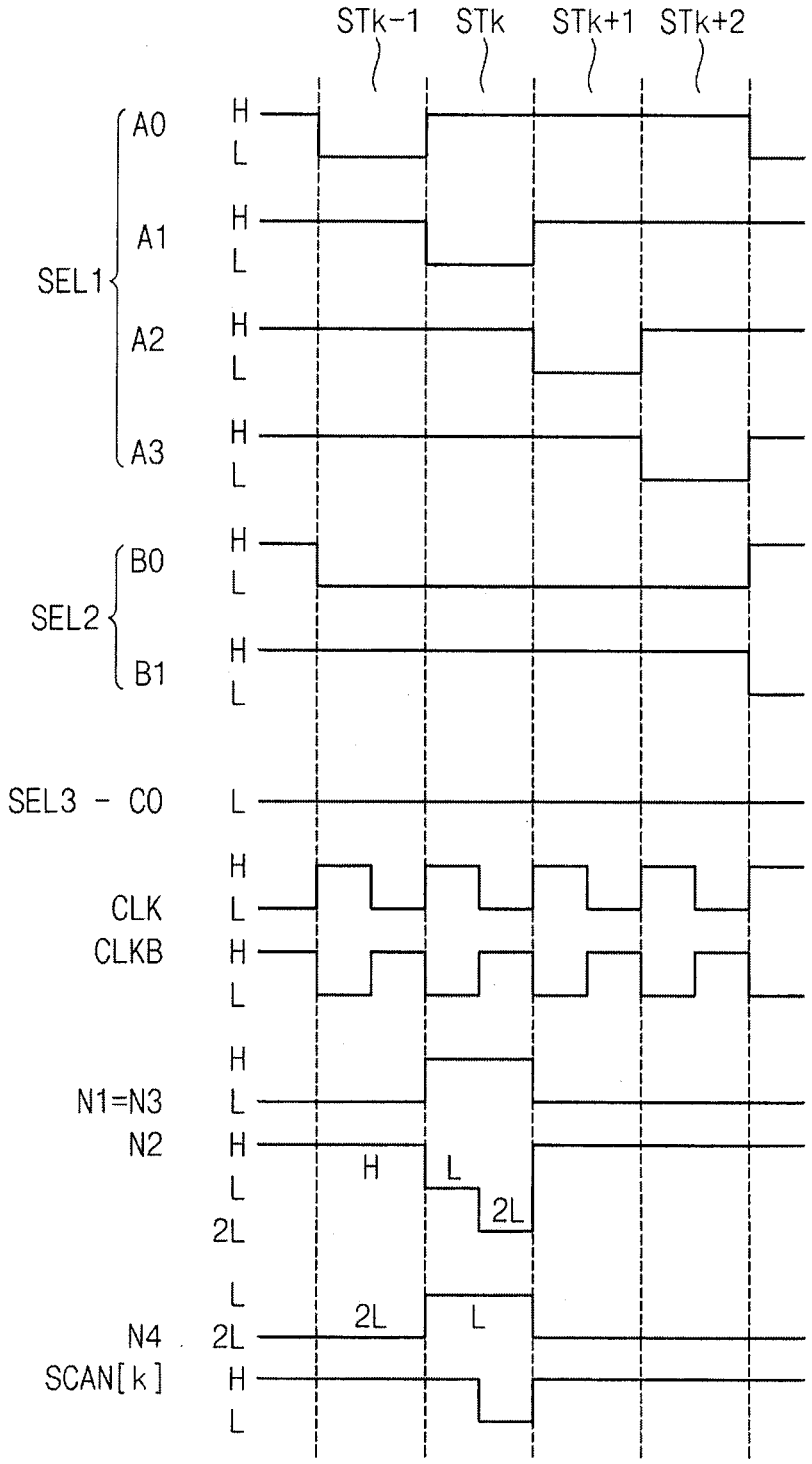
FIG. 6 is a timing diagram for explaining an operation of the k-th stage of FIG. 5.

FIG. 4 is a block diagram illustrating an example of a k-th stage of the scan driver of FIG. 3, FIG. 5 is a circuit diagram illustrating an example of the k-th stage of FIG. 4, and FIG. 6 is a timing diagram for explaining an operation of the k-th stage of FIG. 5.

Referring to FIGS. 4 to 6, each of a plurality of stages 400A may include a first input block 410, a pull-down block 420, a second input block 430, a buffer block 440, and an output block 450.

The first input block 410 may provide a first DC voltage VGH to a first node N1 in response to a plurality of selection signals SEL1, SEL2, and SEL3. The first input block 410 may include first to third switches T1, T2, and T3 connected in series to each other. The first switch T1 may include a gate electrode to which a first selection signal SEL1 is applied, a source electrode to which the first DC voltage VGH is applied, and a drain electrode connected to the second switch T2. The second switch T2 may include a gate electrode to which a second selection signal SEL2 is applied, a source electrode connected to the drain electrode of the first switch T1, and a drain electrode connected to the third switch T3. The third switch T3 may include a gate electrode to which a third selection signal SEL3 is applied, a source electrode connected to the drain electrode of the second switch T2, and a drain electrode connected to the first node N1. In one embodiment, as illustrated in FIG. 3, the first selection signal SEL1 may be a selected one of the selection signals A0, A1, A2, and A3, the second selection signal SEL2 may be a selected one of the selection signals B0, B1, B2, and B3, and the third selection signal SEL3 may be a selected one of the selection signals C0, C1, C2, and C3. The selected signals may be of a low level L, and the other suitable signals may be of a high level H. A first node voltage, that is a voltage at the first node N1, may have the high level (e.g., the first DC voltage VGH) only when all of the first to third selection signals SEL1, SEL2, and SEL3 have low level L.

The pull-down block 420 may provide a second DC voltage VGL to the first node N1 and may pull down the first node voltage. In one embodiment, the pull-down block 420 may include a bootstrap circuit. For example, as illustrated in FIG. 5, the pull-down block 420 may include a first pull-down switch TD1, a second pull-down switch TD2, and a first capacitor C1. The first pull-down switch TD1 may include a gate electrode connected to a fourth node N4, a source electrode connected to the first node N1, and a drain electrode to which the second DC voltage VGL is applied. The second pull-down switch TD2 may be a diode connected transistor. The second pull-down switch TD2 includes a gate electrode connected to a drain electrode, a source electrode connected to the fourth node N4, and the drain electrode to which the second DC voltage VGL is applied. The first capacitor C1 may be connected between the first node N1 and the fourth node N4. The first capacitor C1 may be a bootstrap capacitor. When the first node voltage (i.e., a voltage at the first node N1) is dropped, the first capacitor C1 may drop a fourth node voltage (i.e., a voltage at the fourth node N4) by a voltage corresponding to an amount of a voltage drop of the first node voltage such that the first pull-down switch TD1 may be turned on. Thus, the pull-down block 420 may pull down the first node voltage to the second DC voltage VGL when an operation in which the first input block 410 applies the first DC voltage VGH to the first node N1 is stopped. Here, an internal resistance of the first pull-down switch TD1 may cause the voltage drop of the first node voltage, so that an output voltage level of a scan signal SCAN[k] may be fluctuated or dropped. The buffer block 440 may be added to the stage circuit to solve the problem.

The buffer block 440 may output the first node voltage that is a buffer output voltage (i.e., a third node voltage at a third node N3 of FIG. 5) in response to the first node voltage and the second node voltage. That is, the buffer output voltage may be substantially the same as the first node voltage. The buffer block 440 may provide the buffer output voltage to a scan signal pull-up unit included in the output block 450.

The buffer block 440 may include a first buffer switch TB1 and a second buffer switch TB2 connected in series to each other. The buffer block 440 may provide the buffer output voltage to the output block 450. The first buffer switch TB1 may include a gate electrode connected to a second node N2, a source electrode to which the first DC voltage VGH is applied, and a drain electrode connected to the third node N3. The second buffer switch TB2 may include a gate electrode connected to the first node N1, a source electrode connected to the drain electrode of the first buffer switch TB1, and a drain electrode to which the second DC voltage VGL is applied. Because the buffer block 440 is added to the scan driver, the voltage drop at the first node N1, which is due to the internal resistance of the first to third switches T1, T2, and T3 and the first pull-down switch TD1, may be reduced or prevented.

The second input block 430 may provide the second DC voltage VGL to the second node N2 in response to the selection signals SEL1, SEL2, and SEL3 and the second clock signal CLKB. The second input block 430 may prevent or reduce a voltage drop of a second node voltage, which is a voltage at the second node N2, when the scan signal SCAN[k] outputs. The second input block 430 may include a fourth switch T4, a fifth switch T5, a sixth switch T6, and a cutoff switch TPB connected in series to each other. The fourth switch T4 may include a gate electrode to which the first selection signal SEL1 is applied, a source electrode connected to the second node N2, and a drain electrode connected to the fifth switch T5. The fifth switch T5 may include a gate electrode to which the second selection signal SEL2 is applied, a source electrode connected to the drain electrode of the fourth switch T4, and a drain electrode connected to the sixth switch T6. The sixth switch may include a gate electrode to which the third selection signal SEL3 is applied, a source electrode connected to the drain electrode of the fifth switch T5, and a drain electrode connected to the cutoff switch TPB. The cutoff switch TPB (i.e., a path blocking switch) may include a gate electrode to which the second clock signal CLKB is, applied, a source electrode connected to the drain electrode of the sixth switch T6, and a drain electrode to which the second DC voltage VGL is applied. In one embodiment, the second clock signal CLKB may be a signal inverted from the first clock signal VGH.

The output block 450 may output the scan signal SCAN[k] in response to the second node voltage, the buffer output voltage, and the first clock signal CLK. In one embodiment, the output block 450 may include the scan signal pull-up unit for pulling up the scan signal SCAN[k], and may include a scan signal pull-down unit for pulling down the scan signal SCAN[k]. The output block 450 may include a first output switch TO1 and a second output switch TO2 as the scan signal pull-up unit, and may include a third output switch TO3 and a second capacitor C2 as the scan signal pull-down unit.

The first output switch TO1 may include a gate electrode to which the buffer output voltage is applied, a source electrode connected to the second node N2, and a drain electrode connected to the output terminal OUT. The second output switch TO2 may include a gate electrode to which the buffer output voltage is applied, a source electrode to which the first DC voltage VGH is applied, and a drain electrode connected to the output terminal OUT. The first and second switches TO1 and TO2 may pull up the scan signal SCAN[k] based on the buffer output voltage (i.e., the third node voltage) and may maintain the high level H of the scan signal SCAN[k].

The third output switch TO3 may include a gate electrode connected to the second node N2, a source electrode connected to the output terminal OUT, and a drain electrode to which the first clock signal CLK is applied. The second capacitor C2 may be connected between the second node N2 and the source electrode of the third output switch T03. The second capacitor may operate as a bootstrap capacitor. When the second node voltage has the low level L and the first clock signal CLK becomes the low level, the second node N2 may be bootstrapped by the second capacitor C2. Thus, the second node voltage may be dropped to a second low level 2L, and the scan signal SCAN[k] may be pulled down.

When the second node N2 is bootstrapped, the cutoff switch TPB may be turned off by the second clock signal CLKB such that a leakage path of a current from the output block 450 to the second input block 430 may be blocked. Thus, the voltage drop at the second node N2 due to the leakage current (or the leakage path) may be reduced or prevented.

Referring to FIG. 6, an operation of the k-th stage 400A of the second scan driver 400 will be described. The k-th stage 400A may output a k-th scan signal SCAN[k] to a k-th scan line.

As illustrated in FIG. 6, an A1 signal of the first selection signal SEL1, a B0 signal of the second selection signal SEL2, and a C0 signal of the third selection signal SEL3 may be applied to the k-th stage 400A. Similarly, an A0 signal of the first selection signal SEL1, the B0 signal of the second selection signal SEL2, and the C0 signal of the third selection signal SEL3 may be applied to the (k−1)-th stage STk−1, and an A2 signal of the first selection signal SEL1, the B0 signal of the second selection signal SEL2, and the C0 signal of the third selection signal SEL3 may be applied to the (k+1)-th stage STk+1.

In one embodiment, the first through third selection signals SLE1, SEL2, an SEL3 may be digital signals.

The first through third selection signals SEL1, SEL2, and SEL3 (i.e., A1, B0, and C0) each having low level L may be applied to the first input block 410 and the second input block 430. Thus, the first through sixth switches T1 through T6 may be turned on. The low level L of the second clock signal CLKB may be also applied to the cutoff switch TPB to turn on the cutoff switch TPB.

Here, the first node N1 (i.e., the first node voltage) may be changed to the high level H (e.g., a voltage level of the first DC voltage VGH) by the first input block 410, and the second node N2 (i.e., the second node voltage) may be changed to the low level L (e.g., a voltage level of the second DC voltage VGL) by the second input block 430. The first node voltage having the high level H and the second node voltage having the low level L may be applied to the buffer block 440 so that the buffer block 440 may output the buffer output voltage having the high level H. For example, the first buffer switch TB1 is turned on and the second buffer switch TB2 is turned off, so that the third node voltage may correspond to the buffer output voltage. The third node voltage may be substantially the same as the first node voltage by the operation of the buffer block 440. The first capacitor C1 in the pull-down block 420 may maintain a voltage difference between the first node N1 and the fourth node N4. Thus, as the low level L of the first node voltage changes to the high level H, the second low level 2L of the fourth node voltage may change to the low level L, which is higher than the second low level 2L. The first clock signal CLK may have the high level H so that the scan signal SCAN[k] may have the high level H.

When the first clock signal CLK changes to the low level L and the second clock signal CLKB changes to the high level H, the second node N2 may be bootstrapped by the second capacitor C2 so that the second node voltage has the second low level 2L and so that the scan signal SCAN[k] having the low level L may be outputted to the output terminal OUT. In other words, the third output switch TO3 of the output block 450 is turned on so that the scan signal SCAN[k] changes to the low level L. Here, the cutoff switch TPB may be turned off to cut off the current path so that the voltage fluctuation and/or the voltage drop at the second node N2 may be prevented or reduced.

When the first through third selection signals SEL1, SEL2, and SEL3 each having low level L are not simultaneously applied to the k-th stage 400A, the high level H of the k-th scan signal SCAN[k] may be maintained.

As described above, the buffer block 440 included in each of the stages of the scan driver may prevent or reduce the voltage drop at the first node N1 due to the internal resistances of the first through third switches T1, T2, and T3 and the first pull down switch TD1 connected in series to each other when the first input block 410 is turned on. The buffer block 440 may also ensure threshold voltage shift margins of the switches. Further, the cutoff switch TPB included in the second input block 430 may cut off the current leakage path from the output block 450 to the second input block 430 based on the second clock signal CLKB that is inverted from the first clock signal CLK. Thus, the voltage level fluctuation of the scan signal SCAN[k] outputted to the scan line may be prevented or reduced, and a reliability of the voltage level of the scan signal SCAN[k] may be improved.

Figure 7:
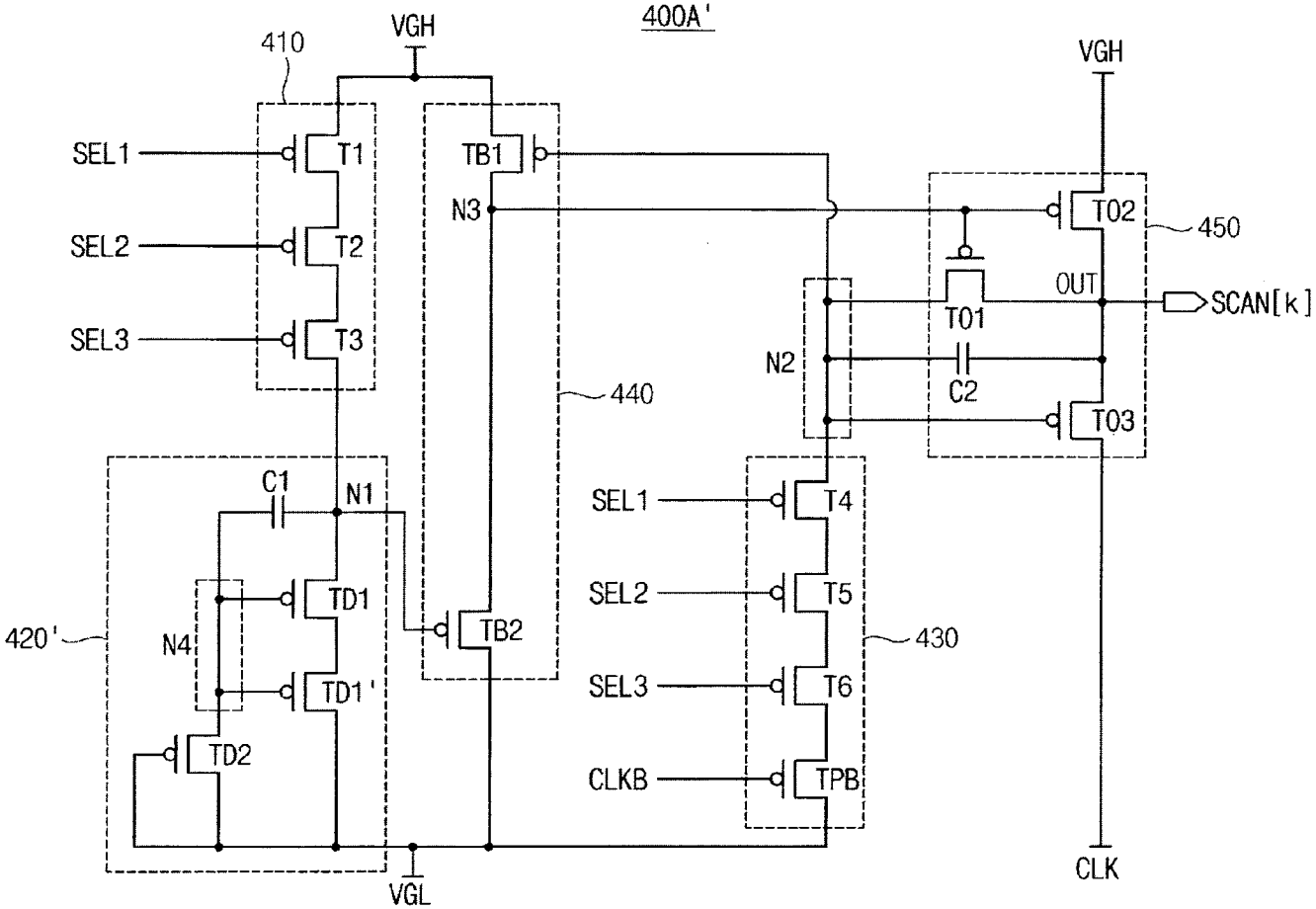
FIG. 7 is a circuit diagram illustrating another example of the k-th stage of FIG. 4.

FIG. 7 is a circuit diagram illustrating another example of the k-th stage of FIG. 4.

In FIG. 7, like reference numerals are used to designate elements/components of the stage circuit that are the same as those in FIG. 5, and repeated detailed description of these elements may be omitted. The stage circuit of FIG. 7 may be substantially the same as, or similar to, the stage circuit of FIG. 5 except for the pull-down block 420'.

Referring to FIG. 7, the k-th stage 400A' of the second scan driver 400 may include a first input block 410, a pull-down block 420', a second input block 430, a buffer block 440, and an output block 450, where k is a positive integer.

The first input block 410 may provide a first DC voltage VGH to a first node N1 in response to a plurality of selection signals SEL1, SEL2, and SEL3. The first input block 410 may include first to third switches T1, T2, and T3 connected in series to each other.

The pull-down block 420' may provide a second DC voltage VGL to the first node N1 and pull down the first node voltage. In one embodiment, the pull-down block 420' may include a bootstrap circuit. As illustrated in FIG. 7, the pull-down block 420' may include first pull-down switches TD1 and TD1', a second pull-down switch TD2, and a first capacitor C1. The first pull-down switches TD1 and TD1' may be a plurality of switches connected in series to each other. Thus, a voltage may be more reliably provided to the first node N1.

The buffer block 440 may output the first node voltage that is a buffer output voltage (i.e., a third node voltage of FIG. 7) in response to the first node voltage and the second node voltage. That is, the buffer output voltage may be substantially the same as the first node voltage. The buffer block 440 may provide the buffer output voltage to a scan signal pull-up unit included in the output block 450. Because the buffer block 440 is added to the scan driver, a voltage drop at the first node N1 due to the internal resistance of the first to third switches T1, T2, and T3 and the first pull-down switches TD1 and TD1' may be reduced or prevented.

The second input block 430 may provide the second DC voltage VGL to the second node N2 in response to the selection signals SEL1, SEL2, and SEL3 and the second clock signal CLKB. The second input block 430 may prevent or reduce a voltage drop of a second node voltage, which is a voltage at the second node N2, when the scan signal SCAN[k] is output. The second input block 430 may include a fourth switch T4, a fifth switch T5, a sixth switch T6, and a cutoff switch TPB connected in series to each other.

The output block 450 may output the scan signal SCAN [k] in response to the second node voltage, the buffer output voltage, and the first clock signal CLK. In one embodiment, the output block 450 may include the scan signal pull-up unit for pulling up the scan signal SCAN[k], and may include a scan signal pull-down unit for pulling down the scan signal SCAN[k]. The output block 450 may include a first output switch TO1 and a second output switch TO2 as the scan signal pull-up unit, and may include a third output switch TO3 and a second capacitor C2 as the scan signal pull-down unit.

When the second node N2 is bootstrapped, the cutoff switch TPB may be turned off by the second clock signal such that a leakage path of a current from the output block 450 to the second input block 430 may be blocked. Thus, the voltage drop at the second node N2 due to the leakage current (or the leakage path) may be reduced or prevented.

Figure 8:
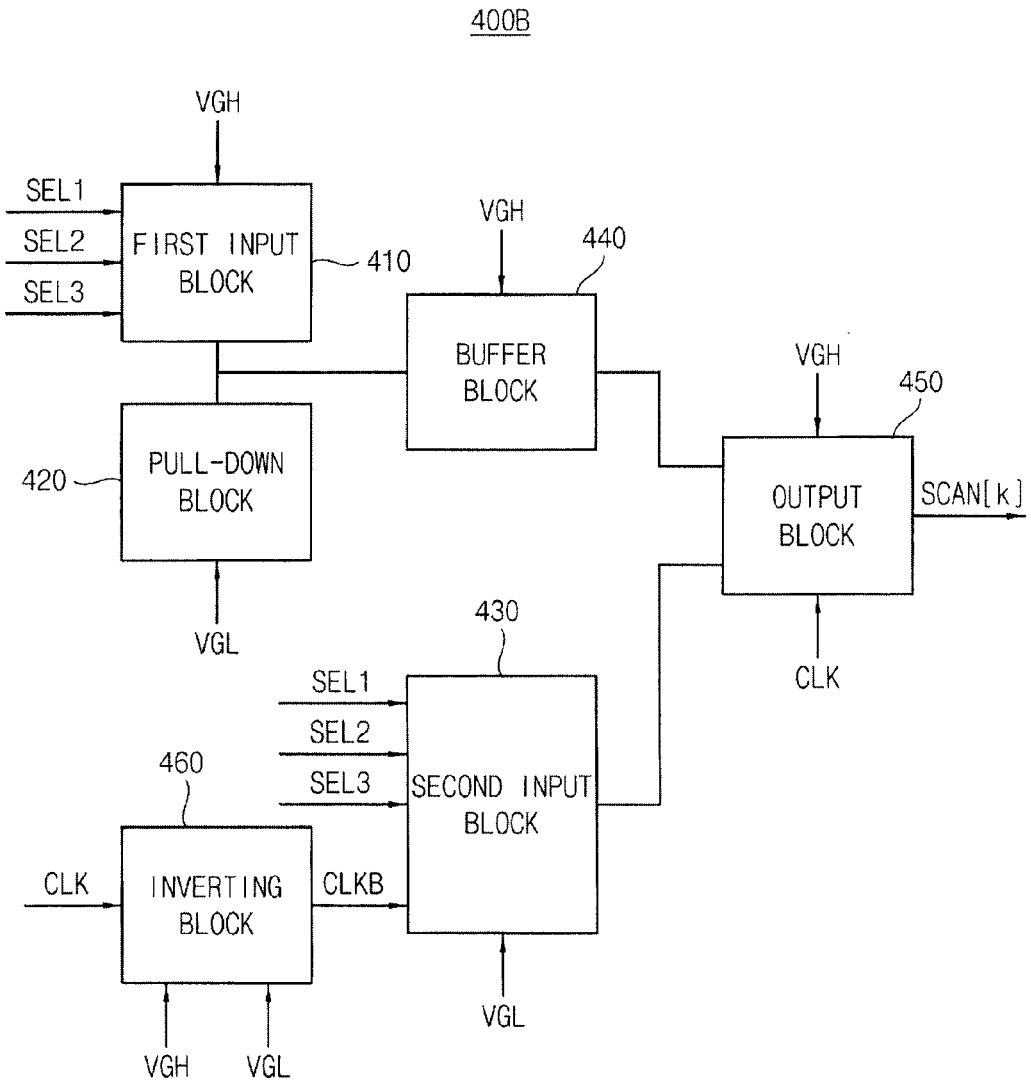
FIG. 8 is a block diagram illustrating another example of a k-th stage of the scan driver of FIG. 3.
Figure 9:
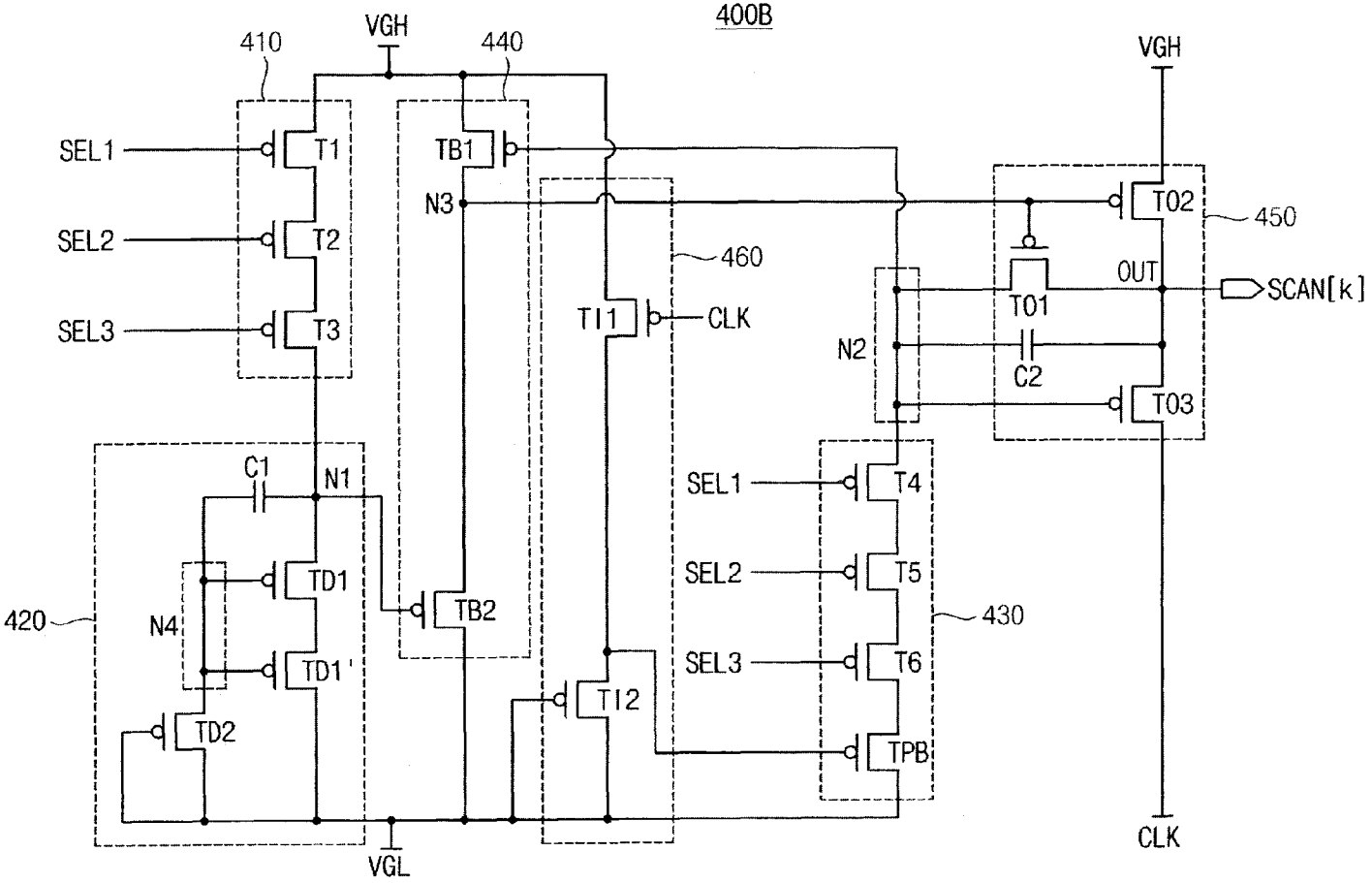
FIG. 9 is a circuit diagram illustrating an example of the k-th stage of FIG. 8.
Figure 10:
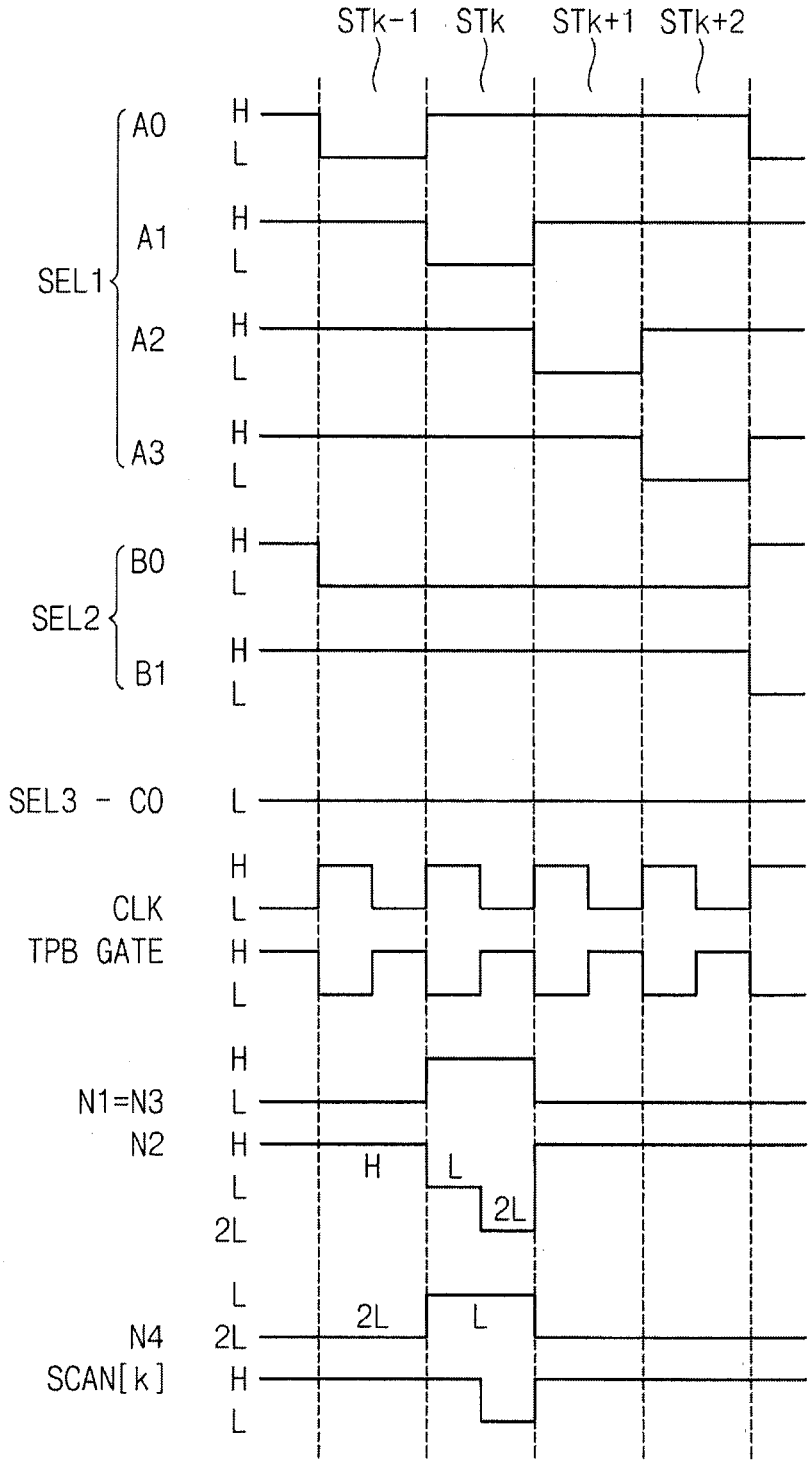
FIG. 10 is a timing diagram for explaining an operation of the k-th stage of FIG. 9.

FIG. 8 is a block diagram illustrating another example of a k-th stage of the scan driver of FIG. 3, FIG. 9 is a circuit diagram illustrating an example of the k-th stage of FIG. 8, and FIG. 10 is a timing diagram for explaining an operation of the k-th stage of FIG. 9.

In FIGS. 8 to 10, like reference numerals are used to designate elements (or components) of the stage circuit that are the same as those in FIGS. 4 to 6, and repeated detailed description of these elements (or components) may be omitted. The stage circuit of FIGS. 8 and 9 may be substantially the same as, or similar to, the stage circuit of FIGS. 4 and 5 except for the addition of an inverting block 460.

Referring to FIGS. 8 to 10, the k-th stage 400B of the second scan driver 400 may include a first input block 410, a pull-down block 420, a second input block 430, a buffer block 440, an output block 450, and an inverting block 460, where k is a positive integer.

The first input block 410 may provide a first DC voltage VGH to a first node N1 in response to a plurality of selection signals SEL1, SEL2, and SEL3. The first input block 410 may include first to third switches T1, T2, and T3 connected in series to each other.

The pull-down block 420 may provide a second DC voltage VGL to the first node N1 and may pull down the first node voltage. As illustrated in FIG. 9, the pull-down block 420 may include a bootstrap circuit.

The buffer block 440 may output the first node voltage that is a buffer output voltage (i.e., a third node voltage of FIG. 9) in response to the first node voltage and the second node voltage. That is, the buffer output voltage may be substantially the same as the first node voltage. The buffer block 440 may provide the buffer output voltage to a scan signal pull-up unit included in the output block 450. Because the buffer block 440 is added to the scan driver, a voltage drop at the first node N1 due to the internal resistance of the first to third switches T1, T2, and T3, and the first pull-down switches TD1 and TD1' may be reduced or prevented.

The second input block 430 may provide the second DC voltage VGL to the second node N2 in response to the selection signals SEL1, SEL2, and SEL3 and the second clock signal CLKB. The second input block 430 may prevent or reduce a voltage drop of a second node voltage, which is a voltage at the second node N2, when the scan signal SCAN[k] is output. The second input block 430 may include a fourth switch T4, a fifth switch T5, a sixth switch T6, and a cutoff switch TPB connected in series to each other. The cutoff switch TPB may include a gate electrode to which a second clock signal CLKB is applied, a source electrode connected to a drain electrode of the fifth switch T5, and a drain electrode to which the second DC voltage VGL is applied.

The output block 450 may output the scan signal SCAN [k] in response to the second node voltage, the buffer output voltage, and the first clock signal CLK. In one embodiment, the output block 450 may include the scan signal pull-up unit for pulling up the scan signal SCAN[k] and may include a scan signal pull-down unit for pulling down the scan signal SCAN[k]. The output block 450 may include a first output switch TO1 and a second output switch TO2 as the scan signal pull-up unit, and may include a third output switch TO3 and a second capacitor C2 as the scan signal pull-down unit.

The k-th stages 400B may further include the inverting block 460 configured to generate the second clock signal CLKB based on the first clock signal CLK. The inverting block 460 may apply the second clock signal CLKB to the gate electrode of the cutoff switch TPB. In one embodiment, the inverting block 460 may include a first inverting switch TI1 and a second inverting switch TI2 connected in series to each other. The first inverting switch TI1 may include a gate electrode to which the first clock signal CLK is applied, a source electrode to which the first DC voltage VGH is applied, and a drain electrode connected to the second inverting switch TI2. The second inverting switch TI2 may include a gate electrode to which the second DC voltage VGL is applied, a source electrode connected to the drain electrode of the first inverting switch TI1, and a drain electrode connected to the gate electrode of the second inverting switch TI2. Here, the gate electrode of the cutoff switch TPB may be connected to the drain electrode of the first inverting switch Ill and the source electrode of the second inverting switch TI2. The inverting block 460 may apply the second clock signal CLKB, which is inverted from the first clock signal CLK, to the gate electrode of the cutoff switch TPB by an operation of the first and second inverting switches Ill and TI2. Thus, an input terminal receiving the second clock signal CLKB from an external device is not required in the second scan driver 400, and the first clock signal CLK may be converted into the second signal CLKB in the stage circuit.

As illustrated in FIG. 10, an A1 signal of the first selection signal SEL1, a B0 signal of the second selection signal SEL2, and a C0 signal of the third selection signal SEL3 may be applied to the k-th stage 400B. Thus, the first through sixth switches T1 through T6 may be turned on. The inverting block 460 may generate the second clock signal CLKB based on the first clock signal CLK. Accordingly, the low level L of the second clock signal CLKB may be applied to the cutoff switch TPB to turn on the cutoff switch TPB. Here, the first node N1 (i.e., the first node voltage) may be changed to the high level H (e.g., a voltage level of the first DC voltage VGH) by the first input block 410, and the second node N2 (i.e., the second node voltage) may be changed to the low level L (e.g., a voltage level of the second DC voltage VGL) by the second input block 430. The third node voltage may have substantially the same as the first node voltage by the operation of the buffer block 440. As the low level L of the first node voltage changes to the high level H, the second low level 2L of the fourth node voltage may change to the low level L that is higher than the second low level 2L. The first clock signal CLK may have the high level H so that the scan signal SCAN[k] may have the high level H.

When the first clock signal CLK changes to the low level L and the second clock signal CLKB changes to the high level H, the second node N2 may be bootstrapped by the second capacitor C2 so that the second node voltage has the second low level 2L and the scan signal SCAN[k] having the low level L may be outputted to the output terminal OUT. Here, the cutoff switch TPB may be turned off to cut off the current path so that the voltage fluctuation and/or the voltage drop at the second node N2 may be prevented or reduced.

When the A0, i.e., the first selection signal SEL1, becomes the high level H, the first and fourth switches T1 and T4 may be turned off. Thus, the first node voltage may be pulled down to the low level L by the operation of the pull-down block 420. The third node voltage may be changed to the low level L by the buffer block 440, and the second node voltage may be changed to the high level H by the third node N3. Here, the fourth node voltage may be bootstrapped by the first capacitor C1 so that the fourth node voltage may be dropped to the second low level 2L.

When the first through third selection signals SEL1, SEL2, and SEL3 each having the low level L are not simultaneously applied to the k-th stage 400A, the high level H of the k-th scan signal SCAN[k] may be maintained.

As described above, the buffer block 440 included in each of the stages of the scan driver may prevent or reduce the voltage drop at the first node N1 due to the internal resistances of the first through third switches T1, T2, and T3 and the first pull down switch TD1 connected in series to each other when the first input block 410 is turned on. The buffer block 440 may also ensure threshold voltage shift margins of the switches. Further, the cutoff switch TPB included in the second input block 430 may cut off the current leakage path from the output block 450 to the second input block 430 based on the second clock signal CLKB inverted from the first clock signal CLK. Thus, the voltage level fluctuation of the scan signal SCAN[k] outputted to the scan line may be prevented or reduced, and a reliability of the voltage level of the scan signal SCAN[k] may be improved.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such suitable modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A scan driver comprising:

a plurality of decoder type stages configured to respectively output a plurality scan signals, an n-th stage of the decoder type stages comprising:

a first input block configured to provide a first direct current (DC) voltage to a first node in response to a plurality of selection signals;

a pull-down block configured to provide a second DC voltage to the first node and to pull down a first node voltage;

a second input block configured to reduce a voltage drop of a second node voltage when a scan signal is output, and to provide the second DC voltage to a second node in response to the selection signals;

a buffer block configured to output the first node voltage as a buffer output voltage in response to the first node voltage and the second node voltage; and an output block configured to output the scan signal in response to the second node voltage, the buffer output voltage, and a first clock signal, wherein n is a positive integer.

2. The scan driver of claim 1, wherein the buffer block comprises:

a first buffer switch; and a second buffer switch connected in series to the first buffer switch, and wherein the buffer block is configured to provide the buffer output voltage to the output block.

3. The scan driver of claim 2, wherein the first buffer switch comprises:

a gate electrode connected to the second node;

a source electrode to which the first DC voltage is configured to be applied; and a drain electrode connected to a third node, and wherein the second buffer switch comprises:

a gate electrode connected to the first node;

a source electrode connected to the drain electrode of the first buffer switch; and a drain electrode to which the second DC voltage is configured to be applied.

4. The scan driver of claim 1, wherein the first input block comprises a first switch, a second switch, and a third switch connected in series to each other, and wherein the second input block comprises a fourth switch, a fifth switch, a sixth switch, and a cutoff switch connected in series to each other.

5. The scan driver of claim 4, wherein the first switch comprises:

a gate electrode to which a first selection signal is configured to be applied;

a source electrode to which the first DC voltage is configured to be applied; and a drain electrode connected to the second switch, wherein the second switch comprises:

a gate electrode to which a second selection signal is configured to be applied;

a source electrode connected to the drain electrode of the first switch; and a drain electrode connected to the third switch, and wherein the third switch comprises:

a gate electrode to which a third selection signal is configured to be applied;

a source electrode connected to the drain electrode of the second switch; and a drain electrode connected to the first node.

6. The scan driver of claim 4, wherein the fourth switch comprises:

a gate electrode to which a first selection signal is configured to be applied;

a source electrode connected to the second node; and a drain electrode connected to the fifth switch, wherein the fifth switch comprises:

a gate electrode to which a second selection signal is configured to be applied;

a source electrode connected to the drain electrode of the fourth switch; and a drain electrode connected to the sixth switch, wherein the sixth switch comprises:

a gate electrode to which a third selection signal is configured to be applied;

a source electrode connected to the drain electrode of the fifth switch; and a drain electrode connected to the cutoff switch, and wherein the cutoff switch comprises:

a gate electrode to which a second clock signal is configured to be applied;

a source electrode connected to the drain electrode of the sixth switch; and a drain electrode to which the second DC voltage is configured to be applied.

7. The scan driver of claim 6, wherein the second clock signal comprises a signal inverted from the first clock signal.

8. The scan driver of claim 6, further comprising an inverting block configured to generate the second clock signal based on the first clock signal, and configured to apply the second clock signal to the gate electrode of the cutoff switch.

9. The scan driver of claim 8, wherein the inverting block comprises a first inverting switch and a second inverting switch connected in series to each other, wherein the first inverting switch comprises:

a gate electrode to which the first clock signal is configured to be applied;

a source electrode to which the first DC voltage is configured to be applied; and a drain electrode connected to the second inverting switch, and wherein the second inverting switch comprises:

a gate electrode to which the second DC voltage is configured to be applied;

a source electrode connected to the drain electrode of the first inverting switch; and a drain electrode connected to the gate electrode of the second inverting switch.

10. The scan driver of claim 9, wherein the gate electrode of the cutoff switch is connected to the drain electrode of the first inverting switch and to the source electrode of the second inverting switch.

11. The scan driver of claim 1, wherein the output block comprises:

a first output switch comprising:

a gate electrode to which the buffer output voltage is configured to be applied;

a source electrode connected to the second node; and a drain electrode connected to an output terminal;

a second output switch comprising:

a gate electrode connected to a third node;

a source electrode to which the first DC voltage is configured to be applied; and a drain electrode connected to the output terminal;

a third output switch comprising:

a gate electrode connected to the second node;

a source electrode connected to the output terminal; and a drain electrode to which the first clock signal is configured to be applied; and a capacitor connected between the second node and the third output switch.

12. The scan driver of claim 11, wherein the second node voltage is configured to be bootstrapped by the capacitor when the third output switch is turned on, so that the scan signal is output.

13. The scan driver of claim 1, wherein the pull-down block comprises a bootstrap circuit, and wherein the pull-down block is configured to pull down the first node voltage into the second DC voltage when an operation in which the first input block applies the first DC voltage to the first node is stopped.

14. The scan driver of claim 1, wherein the second DC voltage is lower than the first DC voltage.

15. A display device comprising:

a display panel comprising a plurality of pixels;

a data driver configured to provide a data signal to the pixels;

a first scan driver configured to provide a scan signal to the pixels; and a second scan driver comprising a decoder type scan driver, and configured to provide a sensing scan signal to the pixels to detect a driving current of each of the pixels in a set sensing period, wherein an n-th stage of the second scan driver comprises:

a first input block configured to provide a first direct current (DC) voltage to a first node in response to a plurality of selection signals;

a pull-down block configured to provide a second DC voltage to the first node and to pull down a first node voltage;

a second input block configured to reduce a voltage drop of a second node voltage when the sensing scan signal is output, and to provide the second DC voltage to a second node in response to the selection signals;

a buffer block configured to output the first node voltage as a buffer output voltage in response to the first node voltage and the second node voltage; and an output block configured to output the sensing scan signal in response to the second node voltage, the buffer output voltage, and a first clock signal, wherein n is a positive integer.

16. The display device of claim 15, wherein the second scan driver is configured to select a sensing scan line, and is configured to output the sensing scan signal to the sensing scan line based on turn-on voltage levels of the selection signals.

17. The display device of claim 15, wherein the buffer block comprises a first buffer switch and a second buffer switch connected in series to each other, and wherein the buffer block is configured to provide the buffer output voltage to the output block.

18. The display device of claim 17, wherein the first buffer switch comprises:

a gate electrode connected to the second node;

a source electrode to which the first DC voltage is configured to be applied; and a drain electrode connected to a third node, and wherein the second buffer switch comprises:

a gate electrode connected to the first node;

a source electrode connected to the drain electrode of the first buffer switch; and a drain electrode to which the second DC voltage is configured to be applied.

19. The display device of claim 15, wherein the second input block comprises a cutoff switch configured to reduce the voltage drop of the second node voltage based on a second clock signal comprising a signal inverted from the first clock signal when the sensing scan signal is output.

20. The display device of claim 15, further comprising a controller configured to control the data driver, the first scan driver, and the second scan driver.

* * * * *